US005686214A

United States Patent [19]

Yu

[11] Patent Number: 5,686,214

[45] Date of Patent: Nov. 11, 1997

[54] ELECTROSTATOGRAPHIC IMAGING MEMBERS

[75] Inventor: Robert C. U. Yu, Webster, N.Y.

[73] Assignee: Xerox Corporation, Stamford, Conn.

[21] Appl. No.: 709,742

[22] Filed: Jun. 3, 1991

[51] Int. Cl.[6] ..... G03G 15/02; G03G 15/04

[52] U.S. Cl. ..... 430/58; 430/62

[58] Field of Search ..... 430/58, 62

[56] References Cited

U.S. PATENT DOCUMENTS

| | | | |
|---|---|---|---|
| 3,973,845 | 8/1976 | Lindblad et al. | 355/15 |
| 4,279,500 | 7/1981 | Kondo et al. | 355/15 |
| 4,390,609 | 6/1983 | Wiedeman | 430/58 |
| 4,404,574 | 9/1983 | Burwasser et al. | 346/153.1 |
| 4,434,220 | 2/1984 | Abbott et al. | 430/108 |
| 4,519,698 | 5/1985 | Kohzama et al. | 355/15 |
| 4,664,995 | 5/1987 | Horgan et al. | 430/64 |
| 4,675,262 | 6/1987 | Tanaka | 430/58 |
| 4,784,928 | 11/1988 | Kan et al. | 430/58 |
| 4,869,982 | 9/1989 | Murphy | 430/48 |
| 4,990,418 | 2/1991 | Mukoh et al. | 430/56 |
| 5,096,795 | 3/1992 | Yu | 430/59 |

FOREIGN PATENT DOCUMENTS

| | | | |
|---|---|---|---|
| 2167199 | 5/1986 | United Kingdom | 430/58 |

OTHER PUBLICATIONS

US Patent Application Ser. No. 07/516,589, filed Apr. 30, 1990.

*Primary Examiner*—George F. Lesmes
*Assistant Examiner*—Bernard P. Codd

[57] ABSTRACT

An electrostatographic imaging member including at least one imaging layer capable of retaining an electrostatic latent image, a supporting substrate layer having an electrically conductive surface and an electrically conductive ground strip layer adjacent the electrostatographic imaging layer and in electrical contact with the electrically conductive surface, the electrically conductive ground strip layer comprising a homogeneous dispersion of conductive particles and solid organic particles in a film forming binder, the organic particles having a low surface energy and an average particle size less than the thickness of the strip layer. This imaging member may fabricated by ultrasonic welding techniques and may be employed in an electrostatographic imaging process.

12 Claims, No Drawings

ELECTROSTATOGRAPHIC IMAGING MEMBERS

BACKGROUND OF THE INVENTION

This invention relates in general to electrostatography and, more specifically, to a flexible electrophotoconductive imaging member having an improved electrically conductive ground strip layer containing an organic additive.

In the art of xerography, a xerographic plate comprising a photoconductive insulating layer over an electrically conductive layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Various combinations of materials for charge generating layers and charge transport layers have been investigated. For example, the photosensitive member described in U.S. Pat. No. 4,265,990 utilizes a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web.

Obviously, the conductive layer may also function as an electrode when the charge transport layer is sandwiched between the conductive layer and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Other electrostatographic imaging devices utilizing an imaging layer overlying a conductive layer include electrographic devices. For flexible electrographic imaging members, the conductive layer is normally sandwiched between a dielectric imaging layer and a supporting flexible substrate. Thus, generally, flexible electrophotographic imaging members generally comprise a flexible recording substrate, a thin electrically conductive layer, and at least one photoconductive layer and electrographic imaging members comprise a conductive layer sandwiched between a dielectric imaging layer and a supporting flexible substrate. Both of these imaging members are species of electrostatographic imaging members.

In order to properly image an electrostatographic imaging member, the conductive layer must be brought into electrical contact with a source of fixed potential elsewhere in the imaging device. This electrical contact must be effective over many thousands of imaging cycles in automatic imaging devices. Since the conductive layer is often a thin vapor deposited metal, long life cannot be achieved with an ordinary electrical contact that rubs directly against the thin conductive layer. One approach to minimize the wear of the thin conductive layer is to use a grounding brush such as that described in U.S. Pat. No. 4,402,593. However, such an arrangement is generally not suitable for extended runs in copiers, duplicators and printers.

Still another approach to improving electrical contact between the thin conductive layer of flexible electrostatographic imaging members and a grounding means is the use of a relatively thick electrically conductive grounding strip layer in contact with the conductive layer and adjacent to one edge of the photoconductive or dielectric imaging layer. Generally the grounding strip layer comprises opaque conductive particles dispersed in a film forming binder. This approach to grounding the thin conductive layer increases the overall life of the imaging layer because it is more durable than the thin conductive layer. However, such relatively thick ground strip layers are still subject to erosion and contribute to the formation of undesirable "dirt" in high volume imaging devices. Erosion is particularly severe in electrographic imaging systems utilizing metallic grounding brushes or sliding metal contacts or grounding blocks. Moreover mechanical failure is accelerated under high humidity conditions.

Also, in systems utilizing a timing light in combination with a timing aperture in the ground strip layer for controlling various functions of imaging devices, the erosion of the ground strip layer by devices such as stainless steel grounding brushes and sliding metal contacts is frequently so severe that the ground strip layer is worn away and becomes transparent thereby allowing light to pass through the ground strip layer and create false timing signals which in turn can cause the imaging device to prematurely shut down. Moreover, the opaque conductive particles formed during erosion of the grounding strip layer tends to drift and settle on other components of the machine such as the lens system, corotron, other electrical components and the like to adversely affect machine performance. For example, at a relative humidity of 85 percent, the ground strip layer life can be as low as 100,000 to 150,000 cycles in high quality electrophotographic imaging members. Also, due to the rapid erosion of the ground strip layer, the electrical conductivity of the ground strip layer can decline to unacceptable levels during extended cycling.

Micro-crystalline silica particles have been added to ground strip layers to enhance mechanical wear life. Photoreceptors containing this type of ground strip are described in U.S. Pat. No. 4,664,995. The incorporation microcrystalline silica particles into ground strip layers has produced excellent improvement in wear resistance. However, due to their extremely hardness, concentrations of silica over about 5 percent in ground strip layers has caused ultrasonic welding horns to rapidly wear as the horn is passed over the ground strip layer during photoreceptor seam welding processes. High welding horn wear is undesirable because horn service life is shortened, horn replacement is very costly, and production line down time is increased.

INFORMATION DISCLOSURE STATEMENT

U.S. Pat. No. 4,869,982 to Murphy, issued Sep. 26, 1989,—An electrophotographic member is disclosed which contains a toner release material in an imaging layer. From about 0.5 to about 20 percent of a toner release agent selected from stearates, silicon oxides and fluorocarbons is incorporated into the imaging layer.

U.S. Pat. No. 4,784,928 to Kan et al, issued Nov. 15, 1988—An electrophotographic element is disclosed in which a photoconductive surface layer comprises finely divided particles of waxy spreadable solid, stearates, polyolefin waxes, and fluorocarbon polymers such as Vydax fluorotelomer from du Pont and Polymist F5A from Allied Chemical Company.

U.S. Pat. No. 4,664,995 to Horgan et al, issued May 12, 1987—An electrostatographic imaging member is disclosed which utilizes a ground strip. The disclosed ground strip material comprises a film forming binder, conductive particles and microcrystalline silica particles dispersed in the film forming binder, and a reaction product of a bi-functional chemical coupling agent which interacts with both the film forming binder and the microcrystalline silica particles.

U.S. Pat. No. 4,279,500 to Kondo et al,, issued Jul. 21, 1981—An electrophotographic imaging apparatus is disclosed comprising an image holding member adapted to retain electrostatic images as well as toner images. The image holding member contains a lubricating agent inside the surface layer. Representative lubricating agents such as polytetrafluoroethylene, polyvinylidene fluoride and numerous other specific materials are listed, for example, in column 6, lines 12–29.

U.S. Pat. No. 3,973,845 to Lindblad et al., issued Aug. 10, 1976—A cleaning blade is disclosed for cleaning residual toner particles from an electrostatic imaging surface comprising a surface having rigid spherical protuberances. Typical spherical protuberances include semi-crystalline, glassy polymers such as polycarbonate, polystyrene and other specific materials listed, for example, in column 4, lines 17–22.

U.S. Pat. No. 4,404,574 to Burwasser et al., issued Sep. 13, 1983—A dielectric record member is disclosed in which a dielectric layer includes an anti-blocking material. Typical anti-blocking materials such as particulate, high density polyethylene (Polymist) and synthetic silicas are listed, for example, in column 3, lines 36–29.

U.S. Pat. No. 4,675,262 to Tanaka, issued Jun. 23, 1987—An electrophotographic member is disclosed comprising a charge generation layer and charge transport layer, the charge transport layer containing powders having a refractive index different from that of the charge transport layer excluding the powders. Various specific powders are listed, for example, in column 4, line 43 to column 5, line 12.

U.S. Pat. No. 4,390,609 to Wiedemann, issued Jun. 28, 1983—An electrophotographic recording material is disclosed comprising an electrically conductive support, an optional insulating intermediate layer, at least one photoconductive layer and a protective transparent cover layer made from a surface abrasion resistant binder. Specific additives of micronized organic or inorganic powders such as polypropylene waxes, polyethylene waxes, etc. for the covering layer are disclosed, for example, in column 5, lines 46–59.

U.S. Pat. No. 4,519,698 to Kobyama et al, issued May 28, 1985—An image forming apparatus is disclosed in which a waxy lubricant such as polypropylene-type wax in a recess of a photosensitive drum is contacted with a cleaning blade during rotation of the drum.

In copending U.S. patent application Ser. No. 7/516,589, filed Apr. 30, 1990 now U.S. Pat. No. 5,096,765, an electrophotographic imaging member is disclosed in which a charge transport layer comprises a thermoplastic film forming binder, aromatic amine charge transport molecules and a homogeneous dispersion of at least one of organic and inorganic particles having a particle diameter less than about 4.5 micrometers, the particles comprising microcrystalline silica, ground glass, synthetic glass spheres, diamond, corundum, topaz, polytetrafluoroethylene, or waxy polyethylene.

Thus, the characteristics of flexible electrostatographic imaging members utilizing ground strip layers exhibit deficiencies which are undesirable in automatic, cyclic electrostatographic imaging systems.

SUMMARY OF THE INVENTION

It is an object of the invention to provide an electrophotographic imaging member which overcomes the above-noted disadvantages.

It is an another object of this invention to provide an electrostatographic imaging member having extended life.

It is still another object of this invention to provide an electrostatographic imaging member that extends the life of seam welding horns.

It is a further object of this invention to provide an electrostatographic imaging member that resists the formation of products of erosion.

It is still another object of this invention to provide an electrostatographic imaging member which maintains conductivity for longer periods.

It is another object of this invention to provide an electrostatographic imaging member which remains opaque for longer periods.

The foregoing objects and others are accomplished in accordance with this invention by providing an electrostatographic imaging member comprising at least one imaging layer capable of retaining an electrostatic latent image, a supporting substrate layer having an electrically conductive surface and an electrically conductive ground strip layer adjacent the electrostatographic imaging layer and in electrical contact with the electrically conductive surface, the electrically conductive ground strip layer comprising a homogeneous dispersion of conductive particles and solid organic particles in a film forming binder, the organic particles having a low surface energy and a particle size less than the thickness of the ground strip layer. This imaging member may be formed by ultrasonic welding techniques and may employed in an electrostatographic imaging process.

The supporting substrate layer having an electrically conductive surface may comprise any suitable rigid or flexible member such as a flexible web or sheet. The supporting substrate layer having an electrically conductive surface may be opaque or substantially transparent and may comprise numerous suitable materials having the required mechanical properties. For example, it may comprise an underlying insulating support layer coated with a thin flexible electrically conductive layer, or merely a conductive layer having sufficient internal strength to support the electrophotoconductive layer and ground strip layer. Thus, the electrically conductive layer may comprise the entire supporting substrate layer or merely be present as a component of the supporting substrate layer, for example, as a thin flexible coating on an underlying flexible support member. The electrically conductive layer may comprise any suitable electrically conductive material. Typical electrically conductive layers including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range, for example, in thicknesses of from about 50 Angstrom units to many centimeters. When a highly flexible photoresponsive imaging device is desired, the thickness of conductive metal layers may be between about 100 Angstroms to about 750 Angstroms. If an underlying flexible support layer is employed, it may be of any conventional material including metal, plastics and the like. Typical underlying flexible support layers include insulating non-conducting materials comprising various resins known for this purpose including, for example, polyesters, polycarbonates, polyamides, polyurethanes, and the like. The coated or uncoated supporting substrate layer having an electrically conductive surface may be rigid or flexible and may have any number of different configurations such as, for example, a sheet, a cylinder, a scroll, an endless flexible belt, and the like. Preferably, the flexible supporting substrate layer having an electrically conductive surface comprises an endless flexible belt of commercially available polyethylene terephthalate polyester coated with a thin flexible metal coating.

The electrostatographic imaging layer may comprise an electrophotographic imaging layer or and electrographic imaging layer. Any suitable electrographic imaging layer may be employed. Typical electrographic imaging layers are high dielectric layers which will retain a deposited electrostatic latent image until development is completed. Examples of electrographic imaging layers include, for example, polycarbonate, polyvinyl butyral, acrylic, polyurethane, polyester, and the like.

If desired, any suitable charge blocking layer may be interposed between the conductive layer and the imaging layer if the imaging layer comprises an electrophotographic imaging layer. Some materials can form a layer which functions as both an adhesive layer and charge blocking layer. Any suitable blocking layer material capable of trapping charge carriers may be utilized. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because cyclic stability of the electrophotographic imaging layer is extended. The entire disclosure of U.S. Pat. No. 4,464,450 is incorporated herein by reference. Typical silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylhethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers. The pH of the solution of hydrolyzed silane is carefully controlled to obtain optimum electrical stability. A solution pH between about 4 and about 10 is preferred. Optimum blocking layers are achieved with hydrolyzed silane solutions having a pH between about 7 and about 8, because inhibition of cycling-up and cycling-down characteristics of the resulting treated photoreceptor are maximized. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

Any suitable technique may be utilized to apply the hydrolyzed silane solution to the conductive layer. Typical application techniques include spraying, dip coating, roll coating, wire wound rod coating, and the like. Generally, satisfactory results may be achieved when the reaction product of the hydrolyzed silane forms a blocking layer having a thickness between about 20 Angstroms and about 2,000 Angstroms.

In some cases, intermediate layers between the blocking layer and any adjacent charge generating or photogenerating material may be desired to improve adhesion or to act as an electrical barrier layer. If such layers are utilized, they preferably have a dry thickness between abut 0.01 micrometer to about 5 micrometers. Typical adhesive layers include film-forming polymers such as polyester, polyvinylbutyral, polyvinylpyrolidone, polyurethane, polymethyl methacrylate and the like. Other well known electrophotographic imaging layers include amorphous selenium, halogen doped amorphous selenium, amorphous selenium alloys including selenium arsenic, selenium tellurium, selenium arsenic antimony, halogen doped selenium alloys, cadmium sulfide and the like. Generally, these inorganic photoconductive materials are deposited as a relatively homogeneous layer.

Generally, as indicated above, the electrostatogaphic imaging member may comprise at least one electrophotographic imaging layer capable of retaining an electrostatic latent image, a supporting substrate having an electrically conductive surface, and an electrically conductive ground strip layer adjacent the electrophotographic imaging layer and in electrical contact with the electrically conductive layer, the electrically conductive ground strip layer comprising a film forming binder, conductive particles and crystalline particles dispersed in the film forming binder and a reaction product of a bi-functional chemical coupling agent with both the film forming binder and the crystalline particles. In the electrophotographic imaging member of this invention, the imaging member comprises an electrophotographic imaging layer capable of retaining an electrostatic latent image. The electrophotographic imaging layer may comprise a single layer or multilayers. The layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference.

The electrophotographic imaging layer preferably comprises two electrically operative layers, a charge generating layer and a charge transport layer which is capable of capacitive displacement and which exhibits excellent flexibility.

Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynudear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, U.S. Pat. No. 4,507,480, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(hydroxyether), from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with the light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conducted in the absence of illumination, i.e. at a rate sufficient to prevent the formation and retention of an electrostatic latent image thereon.

Polymers having this characteristic, e.g. capability of transporting holes, have been found to contain repeating units of a polynuclear aromatic hydrocarbon which may also contain heteroatoms such as for example, nitrogen, oxygen or sulfur. Typical polymers include poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble.

The charge transport layer forming mixture preferably comprises an aromatic amine compound of one or more compounds having the general formula:

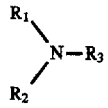

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

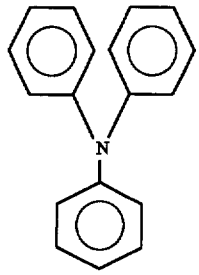

II. Bis and polytriarylamines such as:

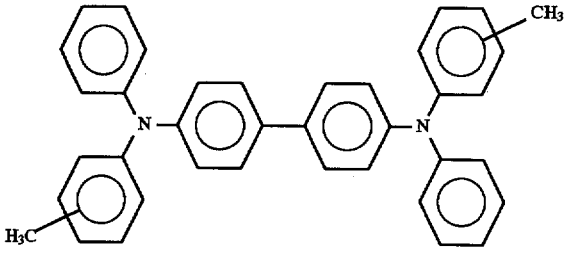

III. Bis arylamine ethers such as:

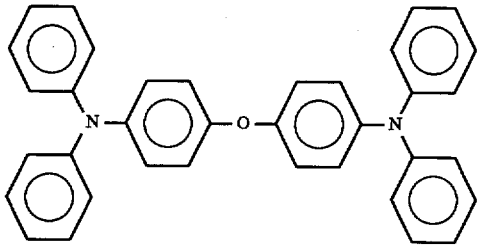

and

IV. Bis alkyl-arylamines such as:

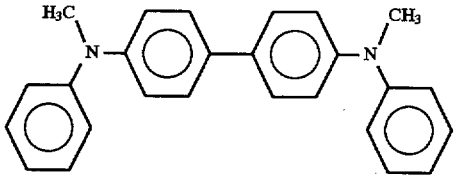

A particularly preferred aromatic amine compound has the general formula:

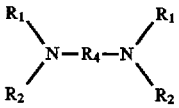

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4'-4"-bis(diethylamino)-2',2"-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder. Although, the above materials pertain to specific the preferred charge transporting specie, aromatic amines, other suitable charge transporting compounds which are soluble or dispersible on a molecular scale in the copolyester binder may be utilized in the overcoating of this invention. The charge transport molecule should be capable of transporting charge carriers injected by the charge injection enabling particles in an applied electric field. The charge transport molecules may be hole transport molecules. Charge transporting materials are well known in the art.

Any suitable inactive resin binder soluble in methylene chloride or other suitable solvents may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A.G. and a polycarbonate resin having a molecular weight of from about 20,000 to about 50,000 available as Merlon from Mobay Chemical Company. Methylene chloride solvent is a preferred component of the charge transport layer coating mixture for adequate dissolving of all the components and for its low boiling point Alternatively, as previously mentioned, the active layer may comprise a photogenerated electron transport material, for example, trinitrofluorenone, poly-N-vinyl carbazole/trinitrofluorenone in a 1:1 mole ratio, and the like.

In all of the above charge transport layers, the activating compound which renders the electrically inactive polymeric material electrically active should be present in amounts of from about 15 to about 75 percent by weight.

Any suitable and conventional technique may be utilized to mix and thereafter apply the charge transport layer coating mixture to the charge generating layer. Typical application techniques include spraying, dip coating, roll coating, wire wound rod coating, and the like. Although it is preferred that the acid doped methylene chloride be prepared prior to application to the charge generating layer, one may instead add the acid to the aromatic amine, to the resin binder or to any combination of the transport layer components prior to coating. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition is about 8.5 percent by weight charge transporting aromatic amine, about 8.5 percent by weight polymeric binder, and about 83 percent by weight methylene chloride. The methylene chloride can contain from about 0.1 ppm to about 1,000 ppm protonic or Lewis acid based on the of weight methylene chloride.

Optionally, an overcoat layer may also be utilized to improve resistance to abrasion. These overcoating layers may comprise organic polymers or inorganic polymers that are electrically insulating or slightly semi-conductive.

The electrically conductive ground strip layer is usually positioned adjacent to the electrostatographic imaging layer and in electrical contact with the electrically conductive layer, the electrically conductive ground strip layer comprising a homogeneous dispersion of conductive particles and solid organic particles in a film forming binder.

Any suitable film forming binder may be utilized in the electrically conductive ground strip layer. For flexible imaging members, the thermoplastic resins should have $T_g$ of at least about 40° C. to impart sufficient rigidity, beam strength and nontackiness to the ground strip layer. The film forming binder is preferably a thermoplastic resin. Typical thermoplastic resins include polycarbonates, polyesters, polyurethanes, acrylate polymers, cellulose polymers, polyamides, nylon, polybutadiene, poly(vinyl chloride), polyisobutylene, polyethylene, polypropylene, polyterephthalate, polystyrene, styrene-acrylonitrile copolymer, ethyl cellulose, polysulfone, polyethersulfone, polyarylate, polyacrylate, and the like and mixtures thereof. A film forming binder of polycarbonate resin is particularly preferred because of its excellent adhesion to adjacent layers, ease if blending with other polymers in the ground strip formulation, formation of good dispersions of conductive particles and achievement of good mechanical strength and flexibility.

Any suitable electrically conductive particles may be used in the electrically conductive ground strip layer of this invention. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and to ensure uniform dispersion of the particles throughout the polymer matrix of the dried ground strip layer. The concentration of the conductive particles to be used in the ground strip depends on factors such as the conductivity of the specific conductive particles utilized. Generally, the concentration of the conductive particles in the ground strip is less than about 35 percent by weight based on the total weight of the dried ground strip in order to maintain sufficient strength and flexibility for the flexible ground strip layers. Excellent results have been achieved with graphite concentrations of about 25 percent by weight based on the total weight of the dried ground strip layer and about 20 percent by weight carbon black based on the total weight of the dried ground strip layer. Sufficient conductive particle concentration is achieved in the dried ground strip layer when the surface resistivity of the ground strip layer is less than about $1\times10^6$ ohms per square and when the volume resistivity is less than about $1\times10^8$ ohm cm. A volume resistivity of about $1\times10^4$ ohm cm is preferred to provide ample latitude for variations in ground strip thickness and variations in the contact area between the outer surface of the ground strip layer and the electrical grounding device. Thus, a sufficient amount of electrically conductive particles should be used to achieve a volume resistivity less than about $1\times10^8$ ohm cm. Excessive amounts of electrically conductive particles will adversely affect the flexibility of the ground strip layer for flexible photoreceptors. For example, a concentration of electrically conductive graphite particles greater than about 45 percent by weight or a concentration of electrically conductive carbon black particles greater than about 20 percent by weight begin to unduly reduce the flexibility of the electrically conductive ground strip layer. The conductive ground strip layer exhibits exceptionally long life on flexible imaging members which are cycled around small diameter guide and drive members many thousands of times.

Any suitable solid organic particles having a low surface energy may be employed. From a thermodynamic point of view, the interface (surface) is a region of finite thickness (usually less than 0.1 micrometer) in which the composition and energy vary continuously from one bulk phase to the other. The pressure (force field) in the interfacial zone is therefore nonhomogeneous, having a gradient perpendicular to the interfacial boundary. In contrast, the pressure in a bulk phase is homogeneous and isotropic. Therefore, no net energy is expended in reversibly transporting the matter within a bulk phase. However, a net energy is required to create an interface by transporting the matter from the bulk phase to the interfacial zone. The reversible work required to create a unit interfacial (surface) area is the interfacial (surface) tension, that is, the excess specific free energy. The expression "low surface energy" is defined as a material which has a satisfactory surface tension of less than about 35 dynes/cm. A surface tension of less than about 30 dynes/cm is preferred. However, optimum results are achieved for a surface tension of less than about 25 dynes/cm. Typical solid organic particles having a low surface energy include polytetrafluoroethylene (e.g. AGLOFLON and POLYMIST both available from Ausimont U.S.A., Inc.), micronized waxy polyethylene (e.g. ACUMIST, available from Allied-Signal, Inc.), metal stearates such as zinc stearate, tin stearate, magnesium stearate and calcium stearate (e.g. available from Synthetic Products), jetted polyethylene wax, fatty amides (e.g. Petrac Erucamide and Oleamide, both available from Synthetic Products), polyamide (e.g. Kelva aramide, available from E. I. dupont de Nemours & Co.), and polyvinylidene fluoride (e.g. Kynar, available from Penwalt), and the like. ALGOFLON comprises irregular shaped polytetrafluoroethylene particles. POLYMIST comprises irregular shaped PTFE particles which are similar to ALGOFLON, with the exception that the particles are gamma ray irradiated to increase their hardness. ACUMIST comprises irregular shaped micronized waxy polyethylene particles having a molecular weight between about 2000 and about 3500. The oxidized form of ACUMIST is a polyethylene homopolymer having the molecular formula $CH_3(CH_2)_mCH_2COOH$. The solid organic particles may have any suitable outer shape. Typical outer shapes include irregular, granular, elliptical, cubic, flake, and the like. The organic particles should have a hardness less than about 3.5 Mohs for satisfactory improvement in reducing welding horn wear and preferably less than 2.5 Mohs for optimum welding horn and ground strip longevity. Preferably, the organic particles should have a particle size less than the thickness of the electrically conductive ground strip layer to avoid an electrically conductive ground strip layer having an excessively irregular outer surface. An average organic particle size between about 0.1 micrometer and about 5 micrometers is preferred to a achieve a relatively smooth outer ground strip surface which prevents bouncing contact with the grounding devices and ensures constant electrical contact.

Generally, for flexible electrostatographic imaging members, the electrically conductive ground strip layer comprises between about 1 percent by weight and about 25 percent by weight of organic particles, based on the total weight of the dried electrically conductive ground strip layer. A concentration of organic particles greater than about 25 percent by weight tends to render the electrically conductive ground strip layer inadequately conductive for practical use as a ground plane. Preferably, the organic particles should have a particle size less than the thickness of the ground strip layer to avoid a ground strip layer having an irregular outer surface. An average organic particle size between about 0.1 micrometer and about 5 micrometers is preferred to achieve a relatively smooth outer surface which does not interfere with moving contact with electrical connectors. Conductive ground strip layers of this invention have been prepared that are sufficiently flexible to bend around a 0.59 inch (1.5 cm) diameter tube without mechanical failure such as cracking or separation from the conductive layer. An organic particle loading of between about 1 percent by weight and about 25 percent by weight is satisfactory. A preferred combination of flexibility, wear and electrical properties are achieved with a concentration of between about 5 percent by weight and about 20 percent by weight of organic particles, based on the total weight of the dried electrically conductive ground strip layer. The optimum condition is between about 10 percent by weight and about 15 percent by weight of particle loading. When less than about 5 percent by weight of the organic particles are utilized, the improvement in wear resistance is relatively slight. The organic particles are easily dispersed by conventional coating composition mixing techniques and form dry ground strip layers in which the organic particles are homogeneously dispersed.

Any suitable conventional coating technique may be utilized to apply the ground strip layer to the supporting substrate layer. Typical coating techniques include solvent coating, extrusion coating, spray coating, lamination, dip coating, solution spin coating and the like. The conductive ground strip layer may be applied directly onto the conductive layer, onto the blocking layer, onto the adhesive layer, and/or partially over the charge generating layer to achieve sufficient electrical contact with the conductive layer. Generally, the blocking and adhesive layers are sufficiently thin to allow electrical contact to occur between the conductive layer and the conductive ground strip layer even though the conductive layer and the conductive ground strip layer are not in actual physical contact with each other. The conductive ground strip layer may be applied prior to, simultaneously with, or subsequent to the application of any of the other layers on the conductive layer. The important criteria is that sufficient electrical contact be achieved to secure an electrically conductive path between an external source of potential and the conductive layer of the imaging member through the conductive ground strip layer. Excellent results may be obtained by coextruding an imaging layer and the electrically conductive ground strip layer as described, for example, in U.S. Pat. No. 4,521,457. The entire disclosure of this patent is incorporated herein by reference. The deposited ground strip layer may be dried by any suitable and conventional drying technique such as oven drying, forced air drying. circulating air oven drying, radiant heat drying, and the like.

The thickness of the electrically conductive ground strip layer should be sufficient to provide a durable electrically conductive layer. For flexible ground strip layers, the thickness should be thin enough to avoid mechanical failure such as cracking or separation from the underlying layer during passage over rollers and rods. Generally, the thickness of the electrically conductive ground strip layer is equal to or less than that of the imaging layer or layers to avoid interference with processing stations during imaging. For example, for an electrophotographic imaging member in which the imaging layer has a thickness of about 26 micrometers on an aluminized Mylar substrate having a thickness of about 76 micrometers, excellent results have been achieved with a 15 micrometers thick electrically conductive ground strip layer containing polycarbonate resin, ethylcellulose, graphite and particles of this invention. Generally, a ground strip layer may have a thickness of between about 7 micrometers and about 42 micrometers, and preferably between about 14 micrometers and about 27 micrometers.

Optimum results are obtained when the electrically conductive ground strip layer coating mixture has a organic particle concentration of between about 10 percent by weight and about 15 percent by weight organic particles based on the total weight of the dried electrically conductive ground strip layer and a solvent for the resin which has a high vapor pressure. When this coating mixture is applied to the supporting substrate, the solvent evaporates rapidly from the thin film and immobilizes the organic particles in the polymer matrix to form a layer in which the organic particles are homogeneously dispersed throughout the thickness of the film. This is particularly desirable for a uniform rate of wear during the life of the imaging member.

A film forming binder mixture of from about 55 percent by weight and about 65 percent by weight polycarbonate resin based upon the total weight of the dried ground strip layer and from about 5 percent by weight and about 10 percent by weight percent ethylcellulose with the remainder being conductive additive and organic particles having a low surface energy, based upon the total weight of the dried ground strip layer, is especially preferred as the film forming binder because of the improved mechanical and electrical properties achieved in the final ground strip layer such as toughness, extended life and uniform particle dispersion. Optimum results are achieved with a deposited ground strip layer film forming binder mixture comprising about 5–10 percent by weight ethylcellulose and about 20–30 percent by weight graphite based upon the total weight of the dried ground strip layer with the remainder being polycarbonate resin and organic particles having a low surface energy to promote surface lubricity and reduce contact friction.

The use of the organic particles of this invention provide significantly superior wear resistant results in ground strip layers compared to ground strip layers without the organic particles. Moreover, the use of the organic particles provide markedly improved welding horn life in electrostatographic belt seam welding processes. The ground strip layers of this invention greatly extend photoreceptor mechanical and electrical life, particularly in systems using abrasive grounding devices such as metallic brushes and sliding metal contacts. For example, mechanical life for a photoreceptor containing a ground strip of this invention was increased by more than 250 percent when subjected to abrasive contact with a pair of stainless steel grounding brushes from a Xerox 1075 electrophotographic duplicator. Moreover, the amount of conductive opaque dirt formed during machine operation is markedly reduced. Surprisingly, the ground strip layer of this invention does not exhibit any significant reduction of conductivity when up to about 10 weight percent of organic particles are added even at low relative humidity, e.g. at 10 percent RH.

A number of examples are set forth hereinbelow and, other than the control examples, are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Test samples were prepared by providing a titanium coated polyester (Melinex, available from ICI Americas Inc.) substrate having a thickness of 3 mils and applying thereto, using a 0.5 mil gap Bird applicator, a solution containing 2.592 gm 3-aminopropyltriethoxysilane, 0.784 gm acetic acid, 180 gms of 190 proof denatured alcohol and 77.3 gms heptane. This layer was then allowed to dry for 5 minutes at room temperature and 10 minutes at 135° C. in a forced air oven. The resulting blocking layer had a dry thickness of 0.05 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a 0.5 mil gap Bird applicator. The adhesive interface layer was allowed to dry for 1 minute at room temperature and 5 minutes at 135° C. in a forced air oven. The resulting adhesive interface layer had a dry thickness of 0.05 micrometer.

The adhesive interface layer was thereafter coated with a ground strip coating mixture. A basic ground strip layer coating mixture was prepared by combining 5.25 gms of polycarbonate resin (Makrolon 5705, 7.87 percent by total weight solids, available from Bayer AG), and 73.17 gms of methylene chloride in a glass container. The container was covered tightly and placed on a roll mill for about 24 hours until the polycarbonate was dissolved in the methylene chloride. The resulting solution was mixed for 15–30 minutes with about 20.72 gms of a graphite dispersion (12.3 Percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser (Tekmar Dispax Dispersator) in a water cooled, jacketed container to prevent the dispersion from overheating and losing solvent. Except for a control sample, either 5 or 10 percent by weight of various organic additive particles, based on the total solids in the dispersion, were added to each coating solution and the dispersion mixtures were again mixed using the Dispax Dispersator as described above. The resulting dispersions were then filtered and the viscosity was adjusted to between 325–375 centipoises with the aid of methylene chloride. These ground strip layer coating mixtures were then applied to the surface of the adhesive interface layer using a 4.5 mil gap Bird applicator, and then dried at 135° C. for 5 minutes in an air circulating oven to yield test samples, each bearing an electrically conductive ground strip layer having a dried thickness of about 18 micrometers. These samples were tested for wear resistance against a glass skid-plate in pressure contact with the ground strip at 25° C. (77° F.) and 35 percent relative humidity. The contact area between the glass skid-plate and the ground strip was 6.2 $cm^2$ and the applied pressure was 146 $gms/cm^2$. Also, the ground strip was tested for electrical resistivities before and after cycling. The test results are tabulated in Table I below:

TABLE I

| Additive | % Additive | Amount Removed After 330,000 Wear Cycles (micrometers) | Bulk Resistivity (ohm-cms) Virgin | 330,000 cycles |
|---|---|---|---|---|
| Control | | 13.0 | 12 | 13 |
| Polymist | 5 | 4.5 | 16 | 15 |
| | 10 | 2.0 | 18 | 19 |
| Agloflon | 5 | 5.0 | 16 | 17 |
| | 10 | 2.5 | 18 | 18 |
| A Cumist | 5 | 6.0 | 14 | 15 |
| | 10 | 3.0 | 16 | 16 |
| Zn Stearate | 5 | 9.5 | 18 | 19 |
| | 10 | 6.0 | 20 | 21 |
| Sn Stearate | 5 | 9.5 | 19 | 20 |
| | 10 | 6.0 | 21 | 21 |
| Jetted PE Wax | 5 | 8.5 | 14 | 15 |
| | 10 | 5.0 | 16 | 15 |
| Petrac Erucamide | 5 | 6.0 | 14 | 15 |
| | 10 | 3.0 | 15 | 15 |
| Kevla Aramide | 5 | 3.5 | 14 | 15 |
| | 10 | 1.5 | 16 | 16 |
| Kynar | 5 | 6.0 | 15 | 16 |
| | 10 | 3.5 | 17 | 18 |

The data in Table I above shows that addition of an organic particle additive having a low surface energy into a ground strip layer can significantly increase its wear resistance. At 10 percent by weight loading of Kevla Aramide, the resistance of the ground strip layer to wear against rubbing contact with a glass skid plate was enhanced by about 767 percent. The least effective on ground strip layer wear improvement, at about 117 percent by weight loading, was the stearates. The presence of metal stearate salts of high molecular weight organic fatty acid additives in the ground strip provides lubrication to enhance mechanical sliding, but have little or no role in directly strengthening the ground strip layer. Although incorporation of organic additives into a ground strip layer slightly alters electrical resistance, the observed changes are surprisingly small. For example, even at the 10 percent by weight level, the additive has substantially little affect on the bulk resistivity of the ground strip. As shown in the last column of the table above, the bulk resistivity of all examples containing organic additives are significantly below the ground $10^4$ ohm-cm.

EXAMPLE II

Test samples were prepared by providing a titanium coated polyester (Melinex, available from ICI Americas Inc.) substrate having a thickness of 3 mils and applying thereto, using a 0.5 mil Bird applicator, a solution containing 2.592 gms 3-aminopropyltriethoxysilane, 0.784 gm acetic acid, 180 gms of 190 proof denatured alcohol and 77.3 gms heptane. This layer was then allowed to dry for 5 minutes at room temperature and 10 minutes at 135° C. in a forced air oven. The resulting blocking layer had a dry thickness of 0.01 micrometer.

An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 5 minutes at 135° C. in a forced air oven. The resulting adhesive interface layer had a dry thickness of 0.05 micrometer.

The adhesive interface layer was thereafter coated with a ground strip coating mixture. A basic ground strip layer coating mixture was prepared by combining 5.25 gms of polycarbonate resin (Makrolon 5705, 7.87 percent by total weight solids, available from Bayer AG), and 73.17 gms of methylene chloride in a glass container. The container was covered tightly and placed on a roll mill for about 24 hours until the polycarbonate was dissolved in the methylene chloride. The resulting solution was mixed for 15–30 minutes with about 20.72 gms of a graphite dispersion (12.3 Percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser (Tekmar Dispax Disperser) in a water cooled, jacketed container to prevent the dispersion from overheating and losing solvent. Except for a control sample, a 10 percent by weight of various organic additive particles, based on the total solids in the dispersion, were added to each coating solution and the dispersion mixtures were again mixed with the Dispax Dispersator as described above. The resulting dispersions were then filtered and the viscosity was adjusted to between 325–375 centipoises with the aid of methylene chloride. These ground strip layer coating mixtures were then applied to the surface of the adhesive interface layer using a 4.5 mil gap Bird applicator, and then dried at 135° C. for 5 minutes in an air circulating oven to yield test samples, each bearing an electrically conductive ground strip layer having a dried thickness of about 18 micrometers. These samples were tested for wear resistance against a glass skid-plate in pressure contact with the ground strip at 32.2° C. (90° F.) and 85 percent relative humidity. The contact area between the glass skid-plate and the ground strip was 6.2 $cm^2$ and the applied pressure was 146 $gms/cm^2$. Also, the ground strip was tested for electrical resistivities before and after cycling. The test results are tabulated in Table II below:

TABLE II

| Additive | % Additive | Amount Removed After 330,000 Wear Cycles (micrometers) | Bulk Resistivity (ohm-cms) Virgin | 100,000 cycles |
|---|---|---|---|---|
| Control | 0 | 12.5 | 12 | 14 |
| Polymist | 10 | 1.5 | 18 | 17 |
| Agloflon | 10. | 2.0 | 18 | 18 |
| Acumist | 10 | 2.5 | 16 | 15 |
| Zn Stearate | 10 | 5.0 | 20 | 22 |
| Sn Stearate | 10 | 5.0 | 21 | 21 |
| PE Wax | 10 | 5.0 | 16 | 17 |

TABLE II-continued

| Additive | % Additive | Amount Removed After 330,000 Wear Cycles (micrometers) | Bulk Resistivity (ohm-cms) Virgin | 100,000 cycles |
|---|---|---|---|---|
| Petrac Erucamide | 10 | 2.5 | 15 | 15 |
| Kevla Aramide | 10 | 1.0 | 16 | 17 |
| Kynar | 10 | 3.0 | 16 | 17 |

The data in Table II illustrates that incorporation of the organic particle additives of this invention in a ground strip can significantly enhance the wear life of ground strips. Ground strip wear life enhancement by the use of low surface energy organic particle additives was more pronounced when testing was carried out under 32.2° C. (90° F.) and 85% RH conditions, particularly in the presence of the hydroscopic characteristics of the cellulose component in the ground strip. The ground strip wear resistance was improved by from about 2.5 times up to about 12.5 times under high temperature/humidity environmental conditions, depending on the type of particulate additive used. No significant ground strip electrical conductivity changes was noted in Tables I and II above before and after cyclic wear tests, thereby indicating that the particulate additives of this invention are electrically compatible for dispersion in ground strip layer formulations. It should be noted that the bulk electrical resistivities of all ground strip examples of this invention listed in the last two columns of Tables I and II are far below $10^4$ ohm-cm. This indicates that all the ground strip examples of this invention are highly electrically conductive.

EXAMPLE III

The control ground strip sample and the ground strip samples of this invention containing 5 percent by weight of organic particles described Example I were taped onto Mylar belts having loop length of about 42 inches (106.6 cm.) Wear tests were conducted on these belts in a fixture under relatively stressful conditions of 105° F. at 85 percent relative humidity. The test device utilized two stationary stainless steel grounding brushes from a Xerox 1075 duplicator applied against all the ground strip test samples with a load of 400 gms on each brush. The normal load on these brushes in a Xerox 1075 machine is about 200 gms per brush. The rate of passage of the electrophotographic imaging members under the brushes was one cycle per sec. The results of the wear test are illustrated below in Table III.

TABLE III

| Additive | Percent Additive | Grnd Strip Thickness (micrometers) | Wear Test (cycles) | Wear Failure |
|---|---|---|---|---|
| None (Control) | 0 | 18 | 255K | Yes |
| Polymist | 5 | 18 | 640K | No |
| Agloflon | 5 | 18 | 640K | No |
| A Cumist | 5 | 18 | 640K | No |
| Zn Stearate | 5 | 18 | 640K | No |
| Sn Stearate | 5 | 18 | 640K | No |
| Jetted PE Wax | 5 | 18 | 640K | No |
| Petrac Erucamide | 5 | 18 | 640K | No |
| Kevla Aramide | 5 | 18 | 640K | No |
| Kynar | 5 | 18 | 640K | No |

Ground strip layer failure was determined to be the point in time when the wearing away of the group strip layer exposed the underlying conductive layer. The tests for the ground strip samples of this invention were terminated at 640,000 cycles with no signs of ground strip layer failure. In sharp contrast, the control ground strip was seen to wear through after only 255,000 cycles of testing. This indicates that the life of the ground strip samples of the present invention was improved more than 250 percent over that of the control ground strip counterpart.

EXAMPLE IV

A ground strip sample was fabricated by following the same procedures and using the same materials as described in Example II, except that the 10 percent by weight of organic particles was replaced by 10 percent by weight silane surface treated micro-crystalline silica. This ground strip sample and all the ground strip samples of this invention having 10 percent by weight organic particle incorporations as described in Example II were tested and compared for the effect of their additives on horn wear during ultrasonic lap joint welding, using a 20 KHZ welding frequency, to form a 10 inch length of welded seam. The exposed ground strip surface of all the samples faced the horn during the welding process. When examined under 10× magnification, slight horn wear was noticeable after only 10 seam weldings for the micro-crystalline silica loaded ground strip samples. However, under the same welding conditions, horn wear was not evident for ground strips containing the organic particles additives of this invention.

When tested for ultimate tensile seam strength, all ground strip seams of this invention gave seam strength equivalent to that obtained for a control seam fabricated using a ground strip formulation having no particulate fillers incorporated therein.

EXAMPLE V

The procedures of Example II were repeated with the same materials as used in Example II to prepare ground strip samples having a concentration of the organic particles in the final dried ground strip of 10 percent by weight based on the total weight of the final dried ground strip, a final ground strip thickness of 18 micrometers. These ground strips were tested for ground strip adhesion. A cross hatch pattern was formed on the ground strip layer by cutting through the thickness of the ground strip layer with a a razor blade. The cross hatch pattern consisted of perpendicular slices 5 mm apart to form tiny separate squares of the ground strip layer. Adhesive tapes were then pressed against the ground strip layer and thereafter peeled from the ground strip layer. The tests were made with two different adhesive tapes. One tape was Scotch Brand Magic Tape #810, available from 3M Corporation having a width of 0.75 in and the other tape was Fas Tape #445, available from Fasson Industrial Div., Avery International. After application of the tapes to the ground strip layer, one tape of each brand was peeled in a direction perpendicular to the surface of the ground strip layer and one tape of each brand was peeled in a direction parallel to the outer surface of the same tape still adhering to the surface of the ground strip layer. Peeling off of the tapes failed to remove any of the ground strip layer from the underlying layers thereby demonstrating the excellent adhesion of the ground strip layer to the underlying layers.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising at least one imaging layer capable of retaining an electrostatic latent image, a supporting substrate layer having an electrically conductive surface and an electrically conductive ground strip layer adjacent said electrostatographic imaging layer and in electrical contact with said electrically conductive surface, said electrically conductive ground strip layer having a volume resistivity of less than about $1\times10^8$ ohm cm and comprising a homogeneous dispersion of conductive particles and between about 1 percent by weight to about 25 percent by weight of solid organic particles, based on the total weight of the total dry weight of said ground strip layer, uniformly dispersed in a film forming binder, said organic particles having a surface energy of less than about 34 dynes/cm, a hardness less than about 3.5 Mohs and a particle size of between about 0.1 micrometer and about 5 micrometers.

2. An electrostatographic imaging member according to claim 1 wherein said imaging layer comprises an electrophotographic imaging layer.

3. An electrostatographic imaging member according to claim 2 wherein said imaging layer comprises a charge generating layer and a charge transport layer.

4. An electrostatographic imaging member according to claim 1 wherein said imaging member is an electrographic imaging member and said imaging layer comprises a dielectric imaging layer.

5. An electrostatographic imaging member according to claim 1 wherein said organic particles have an average particle size of between about 0.1 and about 5 micrometers.

6. An electrostatographic imaging member according to claim 1 wherein said supporting layer comprises a flexible resin layer coated with a thin flexible electrically conductive layer.

7. An electrostatographic imaging member according to claim 1 wherein said film forming binder comprises a thermoplastic resin having a $T_g$ of at least about 40° C.

8. An electrostatographic imaging member according to claim 1 wherein said organic particles comprise polyethylene wax.

9. An electrostatographic imaging member according to claim 1 wherein said organic particles comprise polytetrafluoroethylene.

10. An electrostatographic imaging member according to claim 1 wherein said organic particles comprise a fatty amide.

11. An electrostatographic imaging member according to claim 1 wherein said solid organic particles comprise aramide polyamide.

12. An electrostatographic imaging member according to claim 1 wherein said organic particles comprise a metal stearate.

* * * * *